US006287129B1

(12) United States Patent
Kuo

(10) Patent No.: US 6,287,129 B1
(45) Date of Patent: Sep. 11, 2001

(54) CARD CONNECTOR ASSEMBLY

(75) Inventor: Ming Lun Kuo, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/751,557

(22) Filed: Dec. 29, 2000

(30) Foreign Application Priority Data

Dec. 21, 2000 (TW) ..... 89222273

(51) Int. Cl.[7] ..... H01R 12/20
(52) U.S. Cl. ..... 439/79; 439/541.5; 439/65
(58) Field of Search ..... 439/79, 62, 64, 439/65, 630, 541.5, 74

(56) References Cited

U.S. PATENT DOCUMENTS 6,065,979 * 5/2000 Lai et al. ..... 439/79
6,089,878 * 7/2000 Meng ..... 439/74
6,116,919 * 9/2000 Tung ..... 439/79
6,116,920 * 9/2000 Yu et al. ..... 439/79

* cited by examiner

*Primary Examiner*—Hien Vu
(74) *Attorney, Agent, or Firm*—Wei Te Chung

(57) ABSTRACT

A card connector assembly 1 for connecting a card to a mother board 7 comprises a card connector 2, a spacer 3 defining a plurality of through holes 33 and a daughter board 4 defining a plurality of conductive holes 43. A plurality of terminals 23 received in a plurality of passageways defined in the card connector 2 are inserted into the conductive holes 43 of the daughter card 4 via the through holes 33 of the spacer 3. The spacer 3 forms a pair of hooks 30 to latch with a pair of protrusions 210 of the card connector 2 and a pair of studs 34 to mate with a pair of recesses 44 of the daughter board 4. The spacer 3 further forms two downwardly extending legs 35 which fit into two cutouts 55 in two corners of a socket connector 5 mounted on a mother board 6 when the daughter board 4 is inserted into the socket connector 5.

5 Claims, 4 Drawing Sheets

CARD CONNECTOR ASSEMBLY

BACKGROUND OF THE INVENTION

1. Field of the Invention

The present invention is related to a card connector assembly, and particularly to a card connector assembly mounted on a mother board through a daughter board.

2. Description of the Related Art

Referring to FIG. 4 of the present application, a conventional card connector assembly 1' comprises a card connector 6', a daughter board 7', and a socket connector 8', wherein the card connector 6' has two side arms 62' and a header connector 63' connecting the side arms 62'. The header connector 63' has an engaging face 631' and a mounting face 632'. A plurality of terminals 61' are received in a plurality of passageways of the header connector 63', respectively. One end of each terminal 61' extends out of the engaging face 631 ' and the other end extends out of the mounting face 632' through a conductive hole 71' of the daughter board 7' to be soldered thereto. A lower portion of the daughter board 7' defines a plurality of golden fingers 72'. When the daughter board 7' is inserted into the socket connector 8', the golden fingers 72' connect with mating terminals 81' of the socket connector 8'. The mating terminals 81' are soldered to the mother board 9'. Thus, the card connector 6' and the mother board 9' are electrically connected together.

There is no positioning means in the conventional card connector assembly whereby the daughter board cannot obtain a good positional accuracy when it is mounted to the card connector. Furthermore, in the prior art there is no positioning means between the daughter board and the socket connector, which causes the daughter board to be easily improperly inserted into the socket. Such an improper insertion may cause a damage of a housing of the socket connector since it is soft than the daughter board. Furthermore, the improper insertion may result in that the daughter cannot have a correct electrical connection with the socket connector. Accordingly, an improved card connector assembly is needed.

BRIEF SUMMARY OF THE INVENTION

An object of the present invention is to provide a card connector assembly which can have a correct connection with a socket connector.

Another object of the present invention is to provide a card connector assembly wherein a daughter board can be precisely mounted to a header connector of the card connector assembly.

To achieve the above-mentioned objects, a card connector assembly comprises a card connector, a spacer defining a plurality of through holes, a daughter board defining a plurality of conductive holes and a rear socket mounted on a mother board. The card connector consists of a header connector with a plurality of terminals received in passageways defined in an insulating housing of the header connector and two arms extending from two lateral sides of the header connector. Each of the terminals extends out of a mounting face of the header connector through a through hole in the spacer. By the help of the spacer which correctly positions the terminals, the terminals are easily and accurately inserted into the conductive holes of the daughter board. Each side arm defines a step portion and a protrusion portion with a guiding face. A hook with a inclined face in accordance with the guiding face extends from the spacer and can latch with the protrusion portion. A pair of studs extending from the spacer in the opposite direction from the hook and fit into a pair of recesses defined in the daughter board. A plurality of golden fingers on a bottom of the daughter board connect electrically with a plurality of mating terminals in the socket connector when the daughter board is inserted into the socket connector.

Other objects, advantages and novel features of the invention will become more apparent from the following detailed description of the preferred embodiment when taken in conjunction with the accompanying drawings.

DETAILED DESCRIPTION OF THE INVENTION

Figure 1:
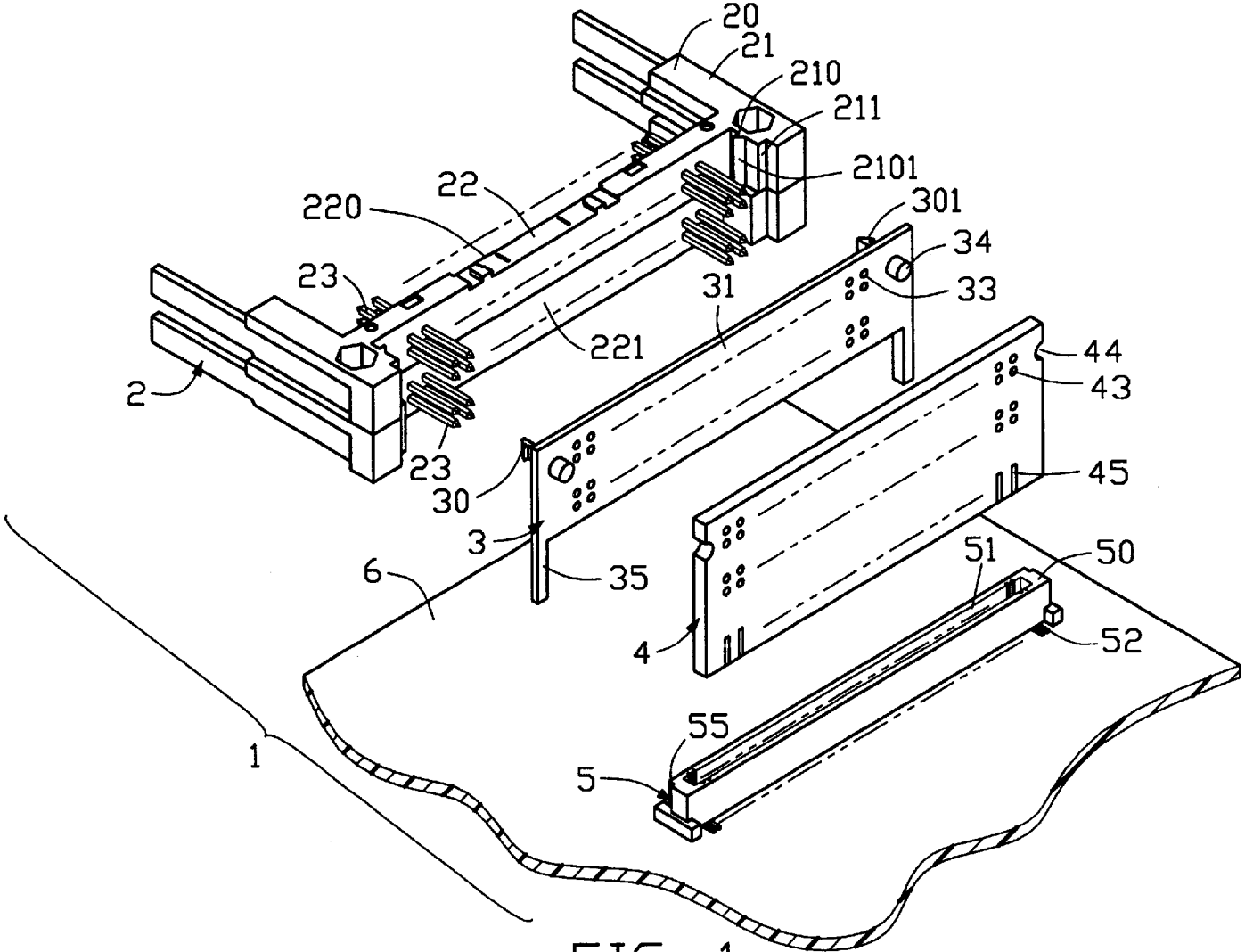
FIG. 1 is perspective view of a card connector assembly in accordance with the present invention and a mother board.
Figure 2:
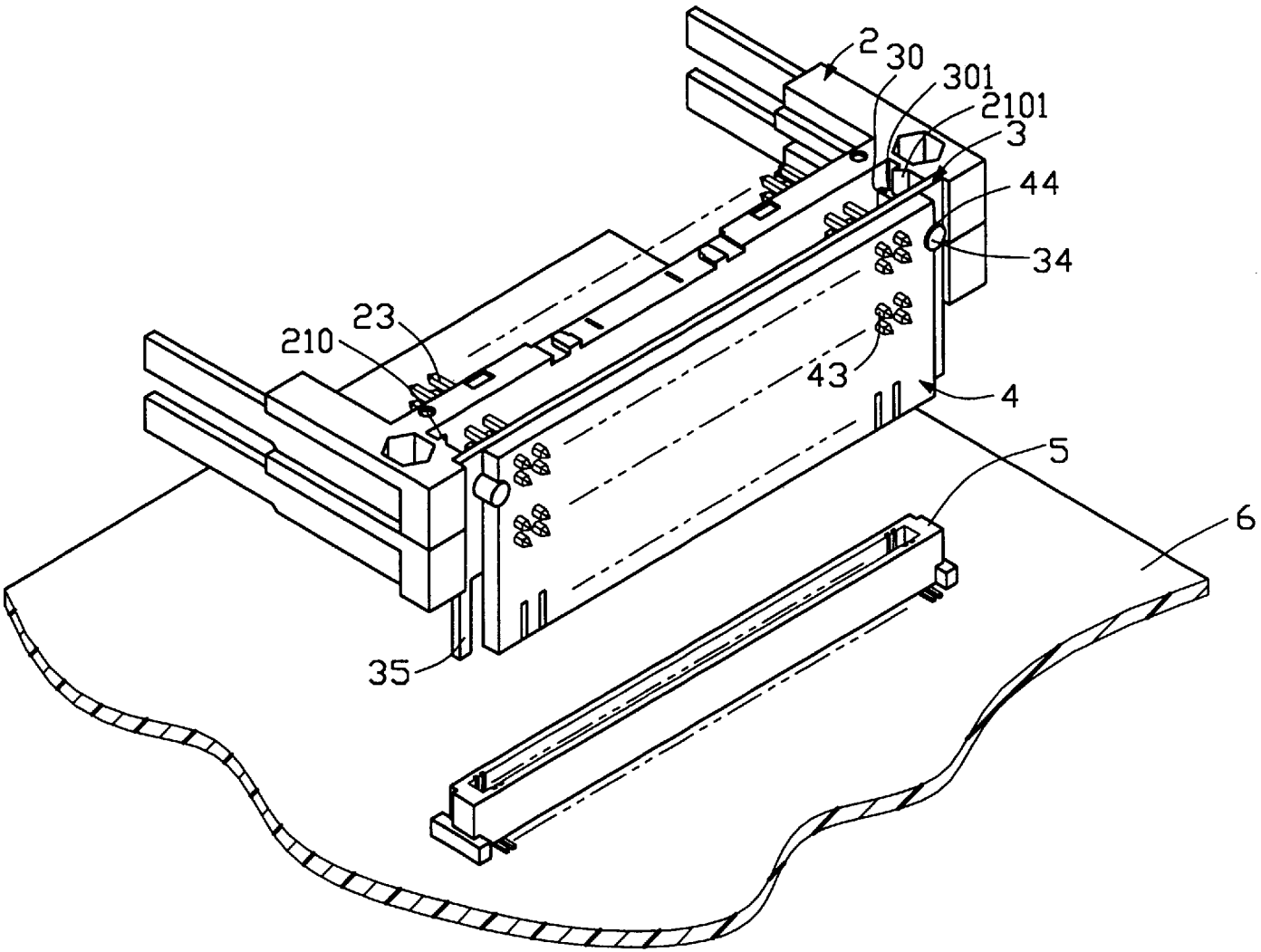
FIG. 2 is a view similar to FIG. 1 with a spacer and a daughter board being assembled to a card connector of the connector assembly.
Figure 3:
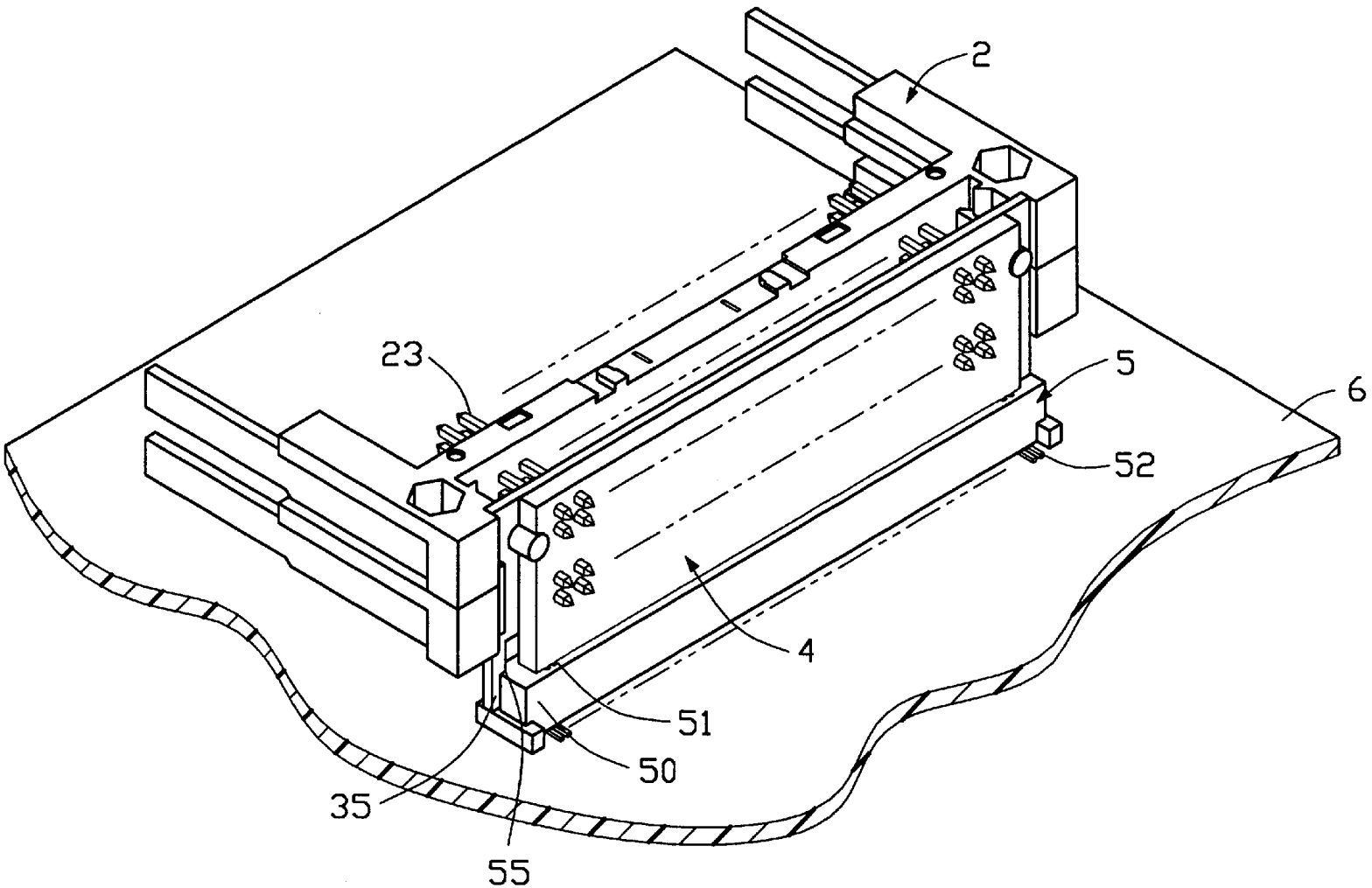
FIG. 3 is a view similar to FIG. 1 showing the card connector assembly and the mother board being assembled together.
Figure 4:
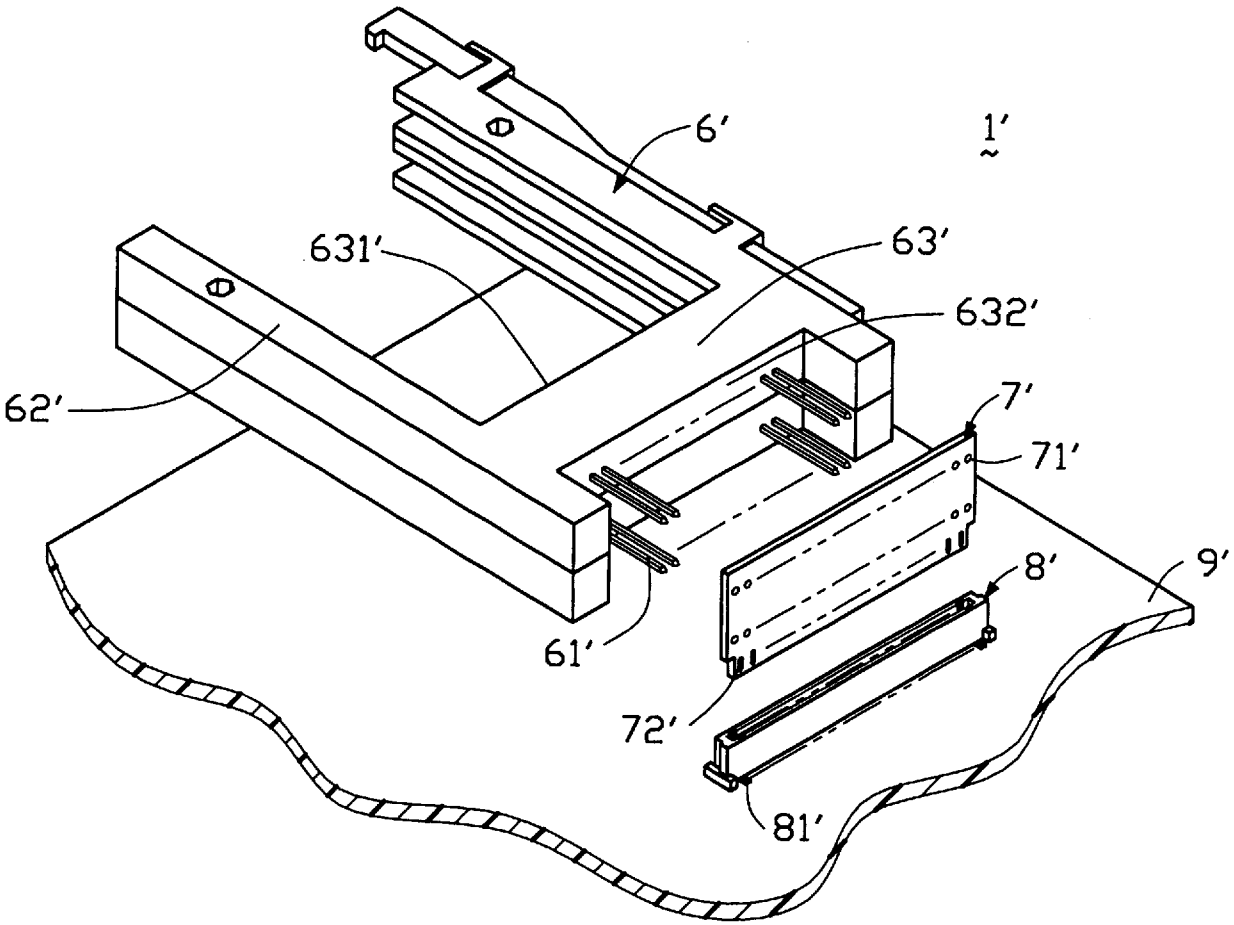
FIG. 4 (PRIOR ART)
FIG. 4 is a perspective view of a conventional card connector assembly and a mother board.

Referring to FIGS. 1–3, a card connector assembly 1 in accordance with the present invention comprises a card connector 2, a spacer 3 defining a plurality of though holes 33 and a daughter board 4 defining a plurality of conductive holes 43. The card connector 2 has a header connector 22 with two side arms 21 extending from two lateral sides, of the header connector 22 for guiding a card (not shown) into/out of the card connector 2. The header connector 22 has an engaging face 220 and a mounting face 221. A plurality of terminals 23 are fixedly received in passageways of the header connector 22. Each terminal has a front end (not labeled) extending beyond the engaging face 220 for electrically connecting with the inserted card, and a rear end (not labeled) extending out of the mounting face 221. Each side arm 21 defines a step portion 211 at an end near the mounting face 221 and a protrusion portion 210 between the mounting face 221 and the step portion 211. The protrusion portion 210 defines an inclined guiding face 2101 facing rearwardly. The spacer 3 includes a rectangular plate 31 defining a number of through holes 33 corresponding to the terminals 23. A pair of hooks 30 project forwardly from an upper portion of lateral sides of a front face of the plate 31. A pair of round studs 34 project rearwards from an upper portion of lateral sides of a rear face of the plate 31. A pair of slender legs 35 each having a rectangular cross section extend downwards from two lateral sides of the plate 31.

The daughter board 4 defines a plurality of conductive through holes 43, a pair of semi-circular recess 44 in an upper portion of lateral sides of the board 4 and a plurality of golden fingers 45 near a bottom edge of the board 4. The golden fingers 45 are electrically connected with the conductive holes 43.

A rear socket 5 is soldered to a mother board 6. The rear socket 5 includes a cubodial housing 50 defining a central slot 51. A plurality of terminals 52 is fixed to the housing 50 with a contacting portion extending into the slot 51 and a tail portion surface mounting to the mother board 6. Two cutouts 55 are defined in two front corners of the housing 50, respectively. Each cutout 55 has a configuration corresponding to the leg 35.

In assembly, particularly referring to FIGS. 2 and 3, the spacer 3 is firstly assembled with the card connector 2 to a position in which the hooks 30 latch with the protrusions 210, the rear ends of the terminals 23 extend through the through holes 33 and an upper portion of lateral edges of the plate 31 abuts against the steps 211. During the assembling, an inclined face 301 of each hook 30 moves over a corresponding guiding face 2101. Thereafter, the daughter board 4 is assembled to the card connector 2 and the spacer 3 to a position in which the rear ends of the terminals 23 extend through corresponding conductive holes 43 of the daughter board 4, and the recesses 44 fittingly receive the studs 34, respectively. Then, soldering operation is applied to the daughter board 4 and the rear ends of the terminals 23 extending beyond a rear face of the daughter board 4 to solder the terminals 23 and the conductive holes 43 together. Finally, the daughter board 4 is inserted into the slot 51 of the rear socket 5 to establish an electrical connection between the golden fingers 45 and the terminals 52. When the daughter board 4 is inserted into the slot 51, the legs 35 of the spacer 3 are fitted into the cutouts 55, respectively.

In the present invention, by the cooperative relation between the steps 211 on the arms 21, the studs 34 on the spacer 3 and the recesses 44 in the daughter board 4, the daughter board 4 can mounted to the card connector 2 at an accurate position. Furthermore, by the cooperative relation between the cutouts 55 and the legs 35, the daughter board 4 can be correctly inserted into the slot 51 without the danger to damage the housing 50.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card connector assembly for connecting a card to a mother board, comprising:

a header connector comprising an insulating housing defining a plurality of passageways through opposite engaging and mounting faces of said insulating housing and a plurality of terminals received in said passageways, each terminal comprising a first end extending out of said engaging face for engaging with an electrical card and a second end extending out of said mounting face;

a spacer defining a plurality of through holes through which the second ends of the terminals extend, said spacer forming a pair of studs extending rearwards therefrom;

a daughter board being so located that the spacer is located between the header connector and the daughter board, said daughter board comprising a plurality of conductive holes to which the second ends of the terminals are soldered, the daughter board defining a pair of recesses, in lateral edges thereof, fittingly receiving said pair of studs of the spacer at a position about lateral sides of the daughter board, respectively; and a rear socket adapted to be mounted to a mother board, said rear socket defining a slot into which a lower edge of the board is inserted so that the header connector and the rear socket are electrically connected together;

wherein said spacer forms two downwardly extending legs fittingly received in the rear socket.

2. The card connector assembly as claimed in claim 1, wherein two arms extend from two lateral sides of the header connector, a step portion being defined on a rear portion of each of the arms, the spacer having lateral edges abutting against the step portions, respectively.

3. The card connector assembly as claimed in claim 2, wherein said spacer forms a pair of hooks latching with protrusions formed on the arms and located between said step portions and said mounting face.

4. The card connector assembly as claimed in claim 3, wherein each of the hooks has an inclined face and each of said protrusions has a guiding face, in which during an assembling of the header connector and the spacer, said inclined faces run over the guiding faces.

5. A card connector assembly for connecting a card to a mother board, comprising:

a header connector comprising an insulating housing defining a plurality of passageways through opposite engaging and mounting faces of said insulating housing and a plurality of terminals received in said passageways, each terminal comprising a first end extending out of said engaging face for engaging with an electrical card and a second end extending out of said mounting face;

a spacer defining a plurality of through holes through which the second ends of the terminals extend and at least one leg extending downwards from said spacer, said spacer forming a pair of studs extending rearwards therefrom;

a daughter board being so located that the spacer is located between the header connector and the daughter board, said daughter board comprising a plurality of conductive holes to which the second ends of the terminals are soldered, the daughter board defining a pair of recesses, in lateral edges thereof, fittingly receiving the pair of studs of the spacer at a position about lateral sides of the daughter board; and a rear socket adapted for mounting to a mother board, defining a central slot into which a lower edge of the daughter board is inserted so that the header connector and the rear socket are electrically connected together, the rear socket fittingly receiving the leg of the spacer whereby an accurate insertion of the daughter board into the slot is ensured; wherein two side arms extend from two lateral sides of said header connector, the spacer has a pair of latches latched with the side arms, and two lateral edges of the spacer abut against two step portions formed on the arms, respectively.

* * * * *